US007022035B2

(12) United States Patent
Morrow et al.

(10) Patent No.: US 7,022,035 B2
(45) Date of Patent: Apr. 4, 2006

(54) LACROSSE HEAD POCKET

(75) Inventors: David Morrow, Farmington Hills, MI (US); Jesse Hubbard, New York, NY (US)

(73) Assignee: Warrior Lacrosse, Inc., Warren, MI (US)

( * ) Notice: Subject to any disclaimer, the term of this patent is extended or adjusted under 35 U.S.C. 154(b) by 0 days.

(21) Appl. No.: 10/238,458

(22) Filed: Sep. 10, 2002

(65) Prior Publication Data

US 2003/0181270 A1 Sep. 25, 2003

Related U.S. Application Data

(63) Continuation-in-part of application No. 10/104,841, filed on Mar. 22, 2002.

(60) Provisional application No. 60/278,532, filed on Mar. 23, 2001.

(51) Int. Cl.
*A63B 59/02* (2006.01)
*A63B 65/12* (2006.01)

(52) U.S. Cl. ..... 473/513; D21/724

(58) Field of Classification Search ..... 473/512, 473/513, 514; D21/724
See application file for complete search history.

(56) References Cited

U.S. PATENT DOCUMENTS 1,279,720 A * 9/1918 Lewis ..... 473/543
4,153,251 A * 5/1979 Pond ..... 473/513
4,861,042 A 8/1989 Trettin
D318,509 S 7/1991 Naumburg, Jr.
5,269,532 A * 12/1993 Tucker et al. ..... 473/513
5,494,297 A * 2/1996 MacNeil ..... 473/513

FOREIGN PATENT DOCUMENTS

GB 1 589 596 * 5/1977

OTHER PUBLICATIONS

Web Page-Readers Tips IX, Apr. 9, 2002, www.e-lacrosse.com/stech51.htlml, 9 pages.*
Web Page-Readers Tips IX, Aug. 2003, www.e-lacrosse.com/stech70.htlml, 10 pages.*
Web Page-Readers Tips XIV, Jun. 2003, www.e-lacrosse.com/stech67.htlml, 14 pages.*

* cited by examiner

*Primary Examiner*—Eugene Kim
*Assistant Examiner*—M. Chambers
(74) *Attorney, Agent, or Firm*—John S. Artz; Artz & Artz, PC

(57) ABSTRACT

A pocket for a lacrosse head (10) includes a netting portion (20) attached to the lacrosse head (10). The netting portion (20) has a plurality of holes (22) therein. The netting portion (20) is characterized by a middle section (28) with a plurality of center holes (32) therein intended to grip a lacrosse ball (24) and provide enhanced ball control characteristics. The netting portion (20) further includes at least one peripheral section (30) with a plurality of peripheral holes (34) therein capable of funneling the lacrosse ball (24) toward the middle section (28) and improving ball retention capabilities of the lacrosse head (10).

12 Claims, 5 Drawing Sheets

LACROSSE HEAD POCKET

CROSS-REFERENCE TO RELATED APPLICATIONS

The present application is a continuation-in-part of U.S. patent application Ser. No. 10/104,841, filed on Mar. 22, 2002, and entitled "Mesh Pocket For Lacrosse Stick", and claims priority from U.S. Provisional Application Ser. No. 60/278,532, filed Mar. 23, 2001, and entitled "Five Hole Mesh For Lacrosse Head".

TECHNICAL FIELD

The present invention relates generally to lacrosse sticks, and more particularly to pockets for heads of lacrosse sticks that provide improved ball retention characteristics, as well as increased shooting and passing accuracy.

BACKGROUND OF THE PRESENT INVENTION

Current lacrosse sticks have heads with one of two known conventional pockets attached thereto. The first type of pocket is a traditional pocket that typically consists of four or more adjustable leather thongs that extend between the lacrosse scoop and the base of the head. Soft fabric laces, i.e. nylon laces, extend between the sidewalls and are interwoven with the thongs to form the pocket for holding the ball in the head. The laces are typically held in place by sidewall strings attached to the opposing sidewalls or are strung directly through the sidewalls themselves. The stiffness of the leather thongs provides for precise ball control in high velocity throwing and shooting.

Disadvantages of known traditional pockets include the extensive maintenance required to maintain the pocket, the damage to the pocket when the leather thongs are exposed to moisture, and poor ball control while running. Repeated use of the pocket typically stretches the leather thongs, which can change the shape of the pocket and its performance. In this respect, the user is typically required to adjust the leather thongs in order to maintain the desired shape, location, and depth of the pocket and its associated performance.

Furthermore, the leather thongs can stretch and shrink unevenly when they dry after being exposed to moisture, such as when lacrosse games are held in the rain. The resulting uneven shrinkage requires further adjustment of the thongs to maintain proper pocket depth and shape.

The second type of conventional pocket is a mesh strung pocket. The mesh pockets are typically formed of a soft fabric material and are comprised of a single unit or structure that attaches to the lacrosse head. Current mesh pockets are typically configured such that they have ten holes across, sometimes referred to as ten hole mesh. Mesh pockets are looser than traditional pockets thereby providing greater ball control while running. Another benefit of this mesh pocket is that it does not require the extensive maintenance that traditional pockets require. Also, mesh pockets are relatively inexpensive to manufacture.

However, the looser netting and the smaller holes therein produce comparably poor throwing and shooting results. In particular, the flexible pocket does not have the required stiffness for providing accurate, high velocity throwing and shooting. In addition, the holes in current mesh pockets are sized such that no portion of the ball is cupped within any one of the holes formed therein. In this regard, the ball merely rests on a top surface of the mesh pocket. This results in less friction between the ball and the pocket thereby reducing ball control, as well as accuracy when the ball is being passed or shot.

Hard synthetic structures which are integrally formed with a head are also known. These structures act as pockets and are typically formed from a plastic material and from known injection molding processes. While these hard pockets are typically integrally formed with the lacrosse head, the lacrosse heads with their associated synthetic pockets are not usable in competitive lacrosse and are typically utilized by children or with non-lacrosse balls, such as plastic balls. This is because hard plastic molded pockets do not have sufficient flexibility and therefore cannot retain a ball in the pocket. These synthetic pockets, however, require almost no maintenance and are relatively inexpensive to manufacture.

Therefore, it would be desirable to provide a lacrosse pocket that provides accurate, high velocity throwing and shooting, affords sufficient ball control while running, requires minimal maintenance, and is also inexpensive.

SUMMARY OF THE PRESENT INVENTION

It is an object of the present invention to provide a coated mesh pocket for a lacrosse head with sufficient stiffness to provide more accurate, higher velocity shooting and passing.

It is another object of the present invention to provide a mesh pocket for a lacrosse head that provides for increased ball retention capabilities.

It is a further object of the present invention to provide a pocket for a lacrosse head that requires decreased maintenance to maintain its desired shape.

It is still another object of the present invention to provide a pocket for a lacrosse head that decreases the amount of slippage or skidding of the lacrosse ball as it is being thrown or passed from the lacrosse pocket.

It is yet another object of the present invention to provide a pocket for a lacrosse head that is less expensive to manufacture and assemble than current lacrosse head pockets.

In accordance with the above and the other objects of the present invention, an improved pocket for a lacrosse head is provided. In one embodiment, the pocket includes a netting portion disposed between a pair of opposing sidewalls of the lacrosse head. The netting portion has a plurality of holes formed therein and preferably has less than nine holes disposed within a majority of horizontal rows between the pair of opposing sidewalls to provide increased ball retention characteristics, as well as increased shooting and passing accuracy.

In accordance with another object of the present invention, a synthetic pocket for a lacrosse head is provided. The synthetic pocket is preferably formed from known injection molding processes and is intended to simulate the playing characteristics of a traditional netting or a mesh netting coated with a stiffening agent. The synthetic pocket also has a no-slip surface to provide friction between the synthetic pocket and a lacrosse ball. The synthetic pocket also has holes of varying sizes, i.e. the holes in the center of the pockets are larger than the holes adjacent to the frame structure.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the present invention.

DETAILED DESCRIPTION OF THE PREFERRED EMBODIMENT

Figure 1:
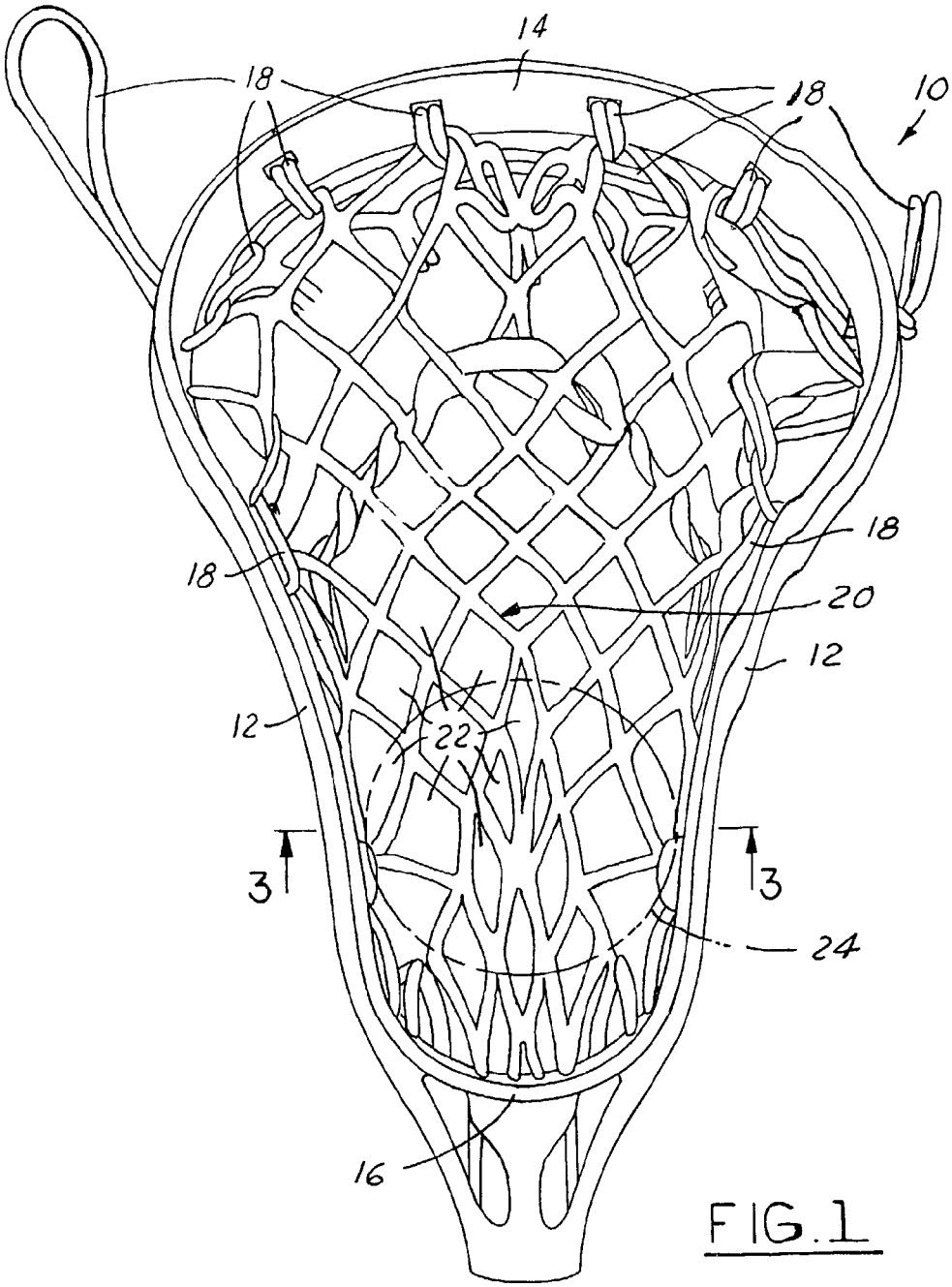
FIG. 1 is a front view of a lacrosse head with a mesh pocket according to a preferred embodiment of the present invention.

In the following figures, the same reference numerals are used to identify the same components in the various views.

Figure 2:
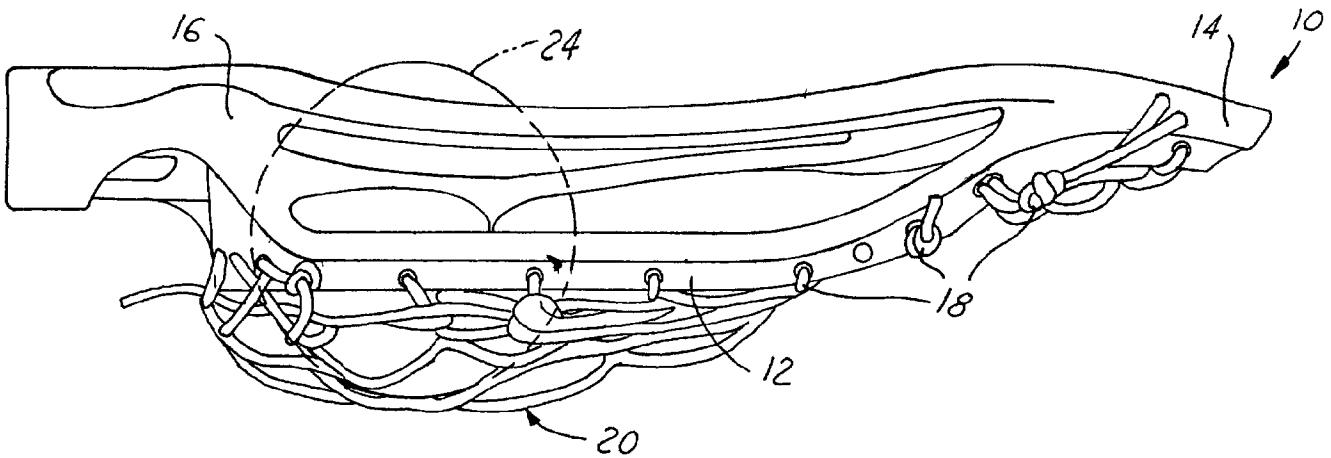
FIG. 2 is a side view of a lacrosse head with a mesh pocket according to a preferred embodiment of the present invention.

Referring to FIGS. 1 and 2, there are shown front and side views, respectively, of a lacrosse head 10 with a mesh pocket according to a preferred embodiment of the present invention. The lacrosse head 10 includes a pair of opposing sidewall portions 12 connected to each other at their top ends by a scoop portion 14 and at their bottom ends by a base portion 16. These portions 12, 14, 16 generally comprise an integral frame.

Preferably, one or more sidewall strings 18 are laced through a series of apertures formed in each of the sidewall portions 12 of the lacrosse head 10. The sidewall strings 18 are interwoven with a netting portion 20 so as to secure the netting portion 20 to the lacrosse head 10. In addition, the top and bottom end portions of the netting portion 20 are preferably tied directly to the lacrosse head 10. Alternatively, it is understood that each side of the netting portion 20 may be secured directly to the lacrosse head 10 by stringing it through the series of apertures formed in each of the portions 12, 14, 16, which eliminates the need for sidewall strings 18.

In the preferred embodiment of the present invention, the netting portion 20 is constructed of a soft fabric material with a plurality of holes 22 therein. The netting portion 20 is preferably composed of a synthetic material, as is well known in the art. Examples of the synthetic material include nylon and polyester. However, it will be understood that other soft materials and various other synthetic materials can be utilized.

Furthermore, the mesh is preferably treated with a stiffening agent, i.e. polyurethane, for hardening the mesh and providing resistance to moisture absorption. By hardening the mesh, the stiffening agent prevents deformation of the pocket thereby allowing the pocket to retain a more uniform shape. The type of stiffening agent and the degree of stiffness will be appreciated by one of ordinary skill in the art as sufficient to allow a pocket to be formed and retained in the netting. In this regard, a well formed pocket treated with the stiffening agent may consistently provide for a desired performance without the need for maintaining the mesh. Furthermore, the increased hardness of the mesh allows for quick release, as well as accurate throwing and shooting with significant speed, i.e. whip.

The stiffening agent water-proofs the mesh so as to prevent the mesh from stretching or shrinking. The stiffening agent thus preserves the shape of the pocket and its associated performance. Also, the resistance to moisture absorption prevents damage to the material composing the netting portion 20. Consequently, the stiffening agent increases the life of the netting portion 20 and causes it to provide performance similar to that of traditional stringing without the expense associated with traditional pockets.

The netting portion 20 preferably has less than nine holes 22 disposed within a majority of the horizontal rows extending between the sidewall portions 12. In the preferred embodiment, the netting portion 20 includes three to six diamond-shaped holes 22, which are disposed within a majority of the horizontal rows. More preferably, the netting portion 20 includes five diamond shaped holes 22 disposed within a majority of the horizontal rows. However, more or less horizontal rows may embody this feature.

Figure 4:
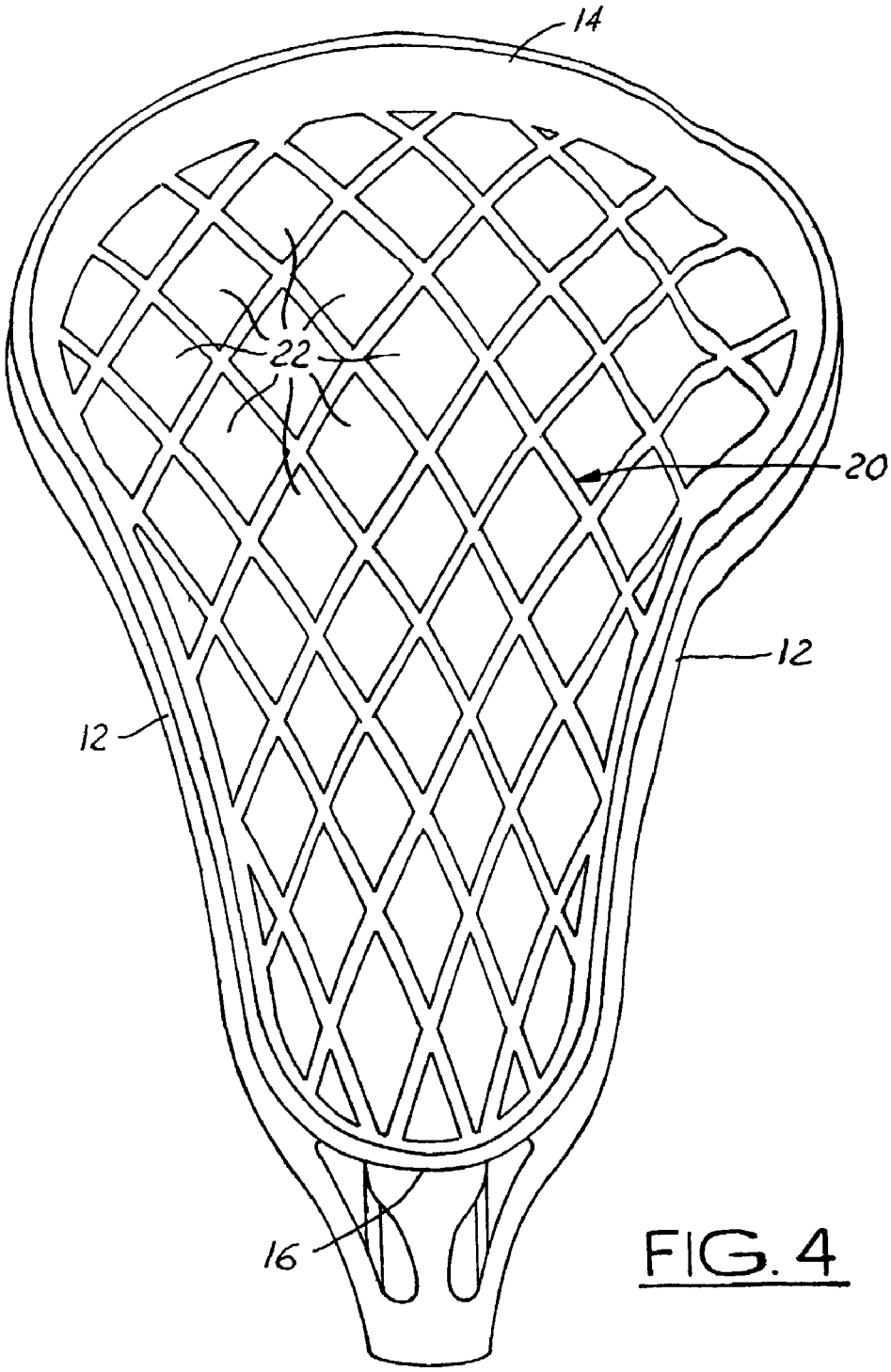
FIG. 4 is a front view of a lacrosse head having a synthetic pocket integrally formed therein according to an alternative preferred embodiment of the present invention.

In an alternative preferred embodiment, as shown in FIG. 4, the netting portion 20 is integrally formed with the lacrosse head 10 thereby dispensing with the need for the sidewall string 18. In particular, the netting portion 20 and the lacrosse head 10 are portions of a single injection molded item. Accordingly, the netting portion 20 is composed of the same material, i.e. plastic, as the lacrosse head 10. As used in this embodiment, the phrase "netting portion" refers to a plastic netting intended to simulate conventional mesh. As a result, the netting portion 20 is sufficiently rigid so as to keep a consistent pocket shape and to reduce maintenance thereof. Furthermore, the stiffness of the netting portion 20 also allows for precise throwing and shooting. The plastic is preferably configured such that it has the flexibility or same characteristics as a traditional pocket. In other words, the netting portion 20 is significantly less flexible than the frame.

Figure 5:
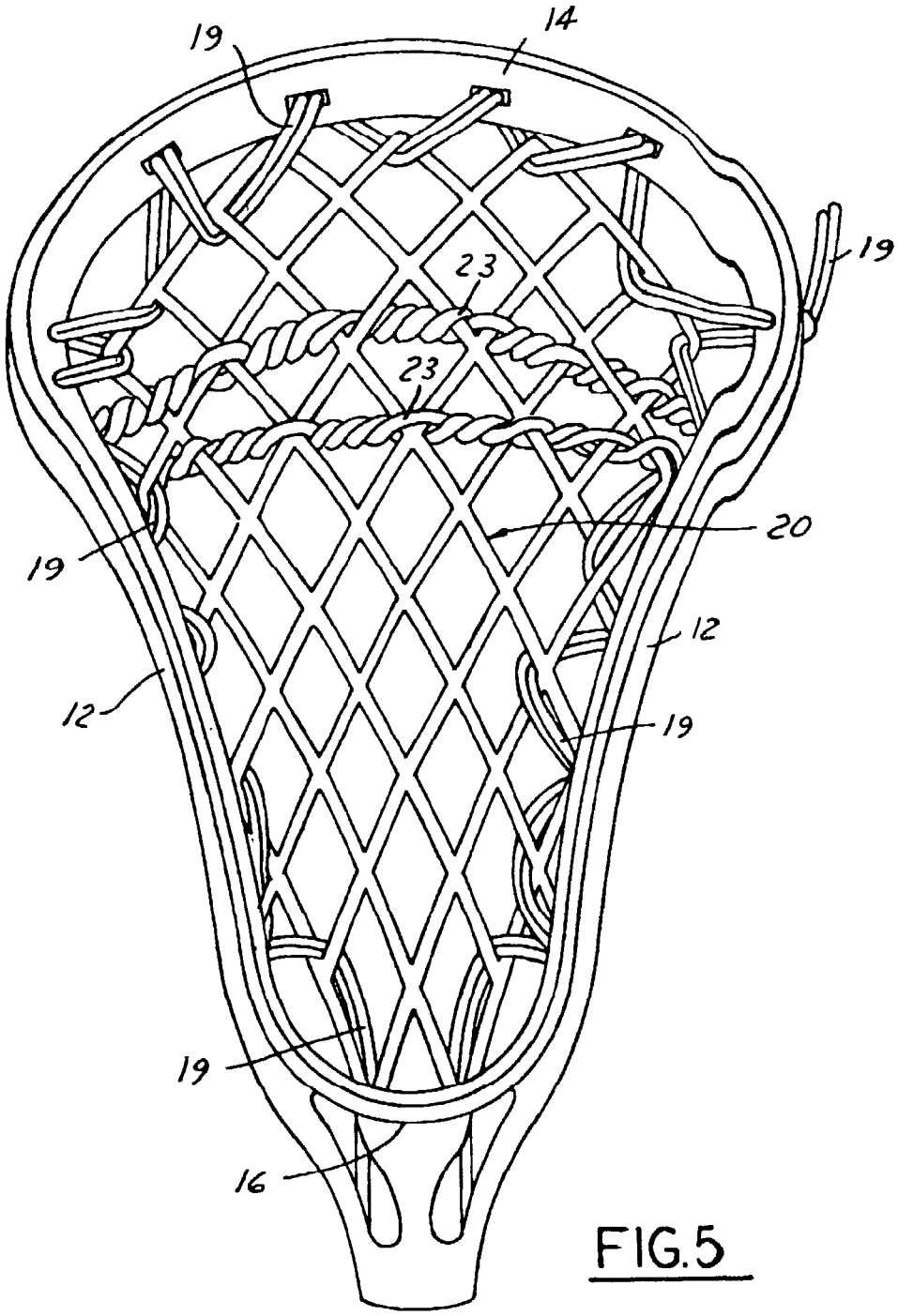
FIG. 5 is a front view of a lacrosse head with a separate integral synthetic pocket secured thereto according to yet another alternative preferred embodiment of the present invention.

As shown in FIG. 5, instead of the netting portion 20 being integrally formed with the head 10, the plastic netting portion 20 can be formed separately in larger sheets of netting and then secured to the head 10 in a separate step after the head 10 has been formed. For example, the netting portion 20 can be cut from the sheet of plastic netting, such as through conventional die cutting processes, and then attached to the frame of the lacrosse head 10, such as by a string 19 interwoven between the netting portion 20 and the stringing apertures in each portion 12, 14, 16 of the lacrosse head. Also, the netting portion 20 can be further secured to the lacrosse head 10 by tying the top end and the bottom end of the netting portion 20 to the scoop portion 14 and the base portion 16, respectively. Alternatively, the netting portion 20 can be passed through each of the apertures formed in the head 10 and then tied off or otherwise secured. Of course, other suitable methods may be employed to secure the netting portion 20 to the lacrosse head 10.

While the netting portion 20 is preferably formed from a polymer material, it will be understood that the netting portion 20 can be formed from any other synthetic material. The netting portion 20 need only be constructed of a material having properties sufficient to fairly replicate traditional stringing with thongs or mesh netting with a stiffening coating applied thereto. It will be understood that the shooting strings 23 can also be molded into the netting. This can be done such that the shooting strings 23 are an integral part of the netting or a separate component that is attached in a subsequent step.

Figure 3:
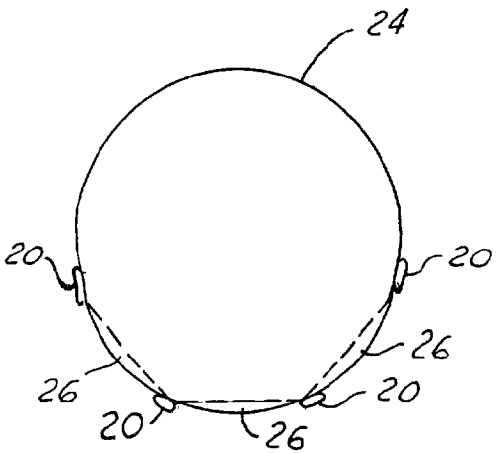
FIG. 3 is a cross-sectional view of a mesh pocket with a lacrosse ball disposed therein, as shown in FIG. 1 taken along line 3—3, according to a preferred embodiment of the present invention.

Turning now to FIG. 3, the preferred embodiment requires that the holes 22 are sized sufficiently large to allow the netting portion 20 to cup portions 26 of a lacrosse ball 24 within the holes 22. This is true for both the netting portion 20 formed of synthetic material as well as the netting portion 20 formed of a plastic material. This type of engagement between the lacrosse ball 24 and the netting portion 20 provides substantial friction between the lacrosse ball 24 and the netting portion 20. Consequently, the user has improved grip on the ball 24 for greater control while handling the ball during play, as well as during throwing and shooting. In an alternative embodiment, the plastic lacing may have a scuffed surface to provide better ball retention. More preferably, the plastic lacing preferably has a no-slip or no-skid surface that is intended to contact the surface of the ball to impart friction thereto. The no-slip surface can be formed across the entire lacing, substantially all of the lacing, a majority of the lacing, or just a part of the pocket of the lacing. The plastic netting alternatively may be formed of a no-slip or no-skid material. The shooting strings 23 preferably have a no-slip surface applied thereto.

In an alternative embodiment, the netting portion 20 may have three or less holes 22 in a horizontal row. By decreasing the number of holes 22 in a horizontal row, the size of each hole 22 will typically increase. The larger size of holes 22 may result in the tendency of the ball 24 to rock from one hole 22 to another hole 22 in the pocket. Such an engagement between the ball 24 and the netting portion 20 can decrease smoothness in handling and overall ball control.

In yet another alternative embodiment, the netting portion 20 may have seven to nine holes 22 disposed within a horizontal row. The increase in the number of holes 22 in a horizontal row will typically decrease the size of the holes 22. As a result, smaller portions 26 of the ball 24 are cupped within the holes 22 thereby decreasing the amount of friction between the netting portion 20 and the ball 24. The reduction in friction may decrease accuracy in throwing and shooting the ball 24.

Figure 6:
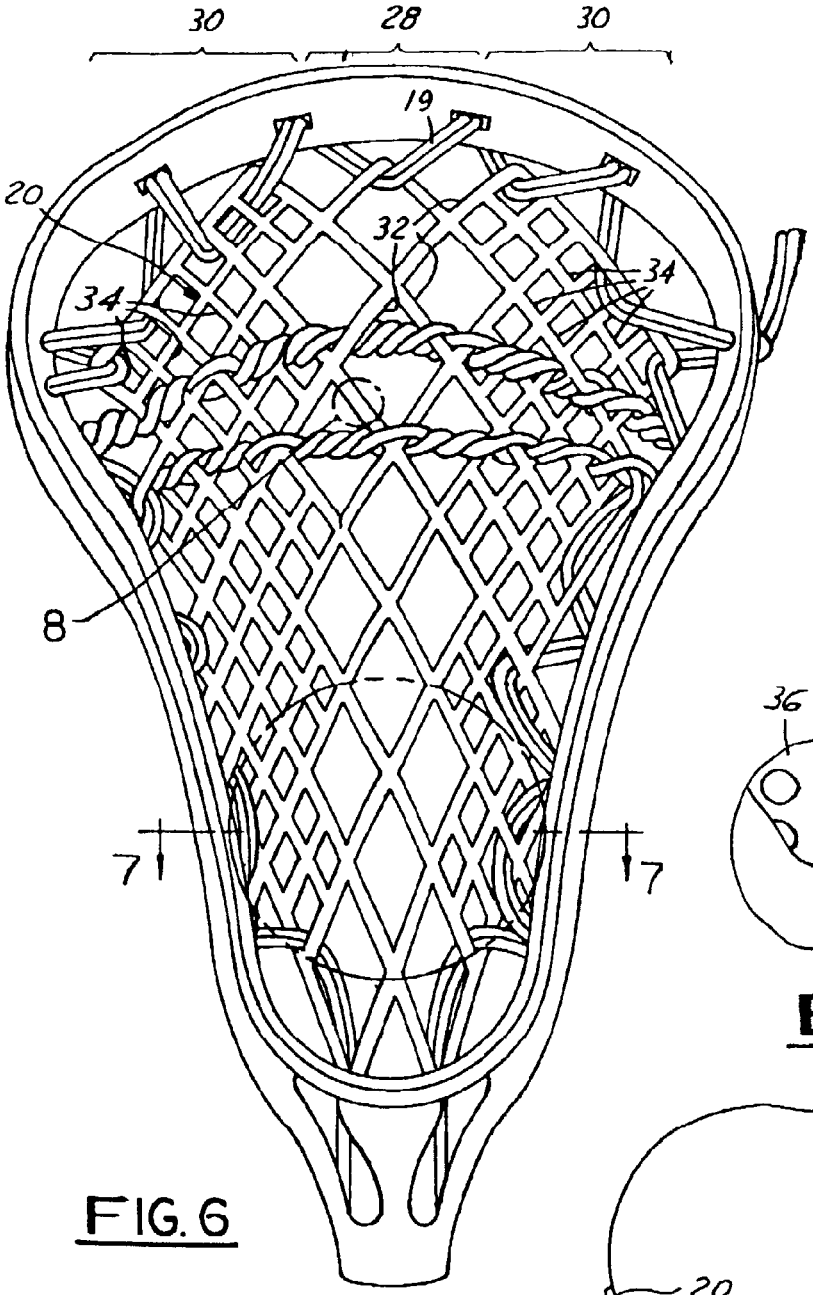
FIG. 6 is a front view of a lacrosse head with a pocket having variable sized holes according to still another alternative preferred embodiment of the present invention.

Referring now to FIG. 6, there is shown a netting portion 20 having variable sized holes according to yet another alternative preferred embodiment. In this embodiment, the netting portion 20 is a single integral piece, which is preferably formed of a plastic material, and is attached to the lacrosse head 10 via a string 19 interwoven between the netting portion 20 and apertures formed within the lacrosse head 10. The netting portion 20 may obviously be attached to the head 10 by a variety of other suitable methods. This netting portion 20 includes a middle section 28 and one or more peripheral or side sections 30 situated between the middle section 28 and the lacrosse head 10.

The holes in the middle section 28 and the peripheral sections 30 are sized for improving ball control characteristics of the netting portion 20 while maintaining a desirable level of ball retention.

Figure 7:
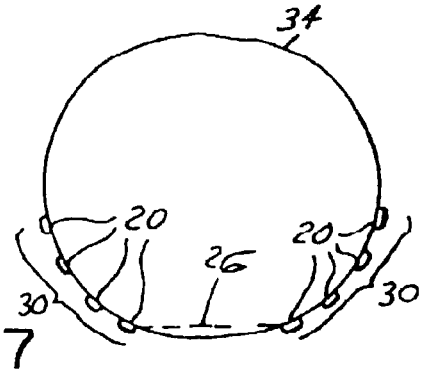
FIG. 7 is a cross-sectional view of a pocket with a lacrosse ball disposed therein, as shown in FIG. 6 taken along line 7—7, according to an alternative preferred embodiment of the present invention.

In particular, the middle section 28 of the netting portion 20 includes a plurality of center holes 32 intended to provide substantial grip on the lacrosse ball 24 thereby improving ball control. As best shown in FIG. 7, the center holes 32 are sized sufficiently large for cupping a portion 26 of the lacrosse ball 24. In this regard, there is substantial friction between the ball 24 and the netting portion 20 thereby enhancing control in throwing and shooting.

In addition, the peripheral sections 30 preferably comprise relatively loose and flexible netting material with a plurality of peripheral holes 34 therein that are sized for funneling the ball 24 toward the middle section 28 to help in retaining the ball 24 within the lacrosse head 10. Each peripheral hole 34 is sized smaller than the center holes 32 in the middle section 28 such that the ball 24 cannot be cupped in the peripheral holes 32. As a result, the ball 24 merely rests on a top surface of the peripheral sections 30 causing the ball to freely roll across those sections 30 toward the larger holes 32 in the middle section 28. Moreover, the flexibility of the peripheral sections 30 enhances ball retention by cushioning movement of the ball 24 as the lacrosse head 10 is suddenly moved. This cushioning effect prevents the ball from rolling or bouncing out off the netting portion 20 and out of the lacrosse head 10. This is particularly beneficial when the user is running or cradling the lacrosse ball 24.

The netting portion 20 may be comprised of an integral plastic injection molded piece or various other suitable structures as desired. This netting portion 20 can be formed from known injection molding processes. However, it can be formed from other suitable forming processes.

In an alternative embodiment, the netting portion 20 may include two or more separate sections connected to each other. For example, the middle section 28 and each peripheral section 30 may be separate pieces of netting attached together to form the netting portion 20. By way of another example, the netting portion 20 can be formed from a nylon material to form a netting of variable sized holes. The netting portion 20 can be formed by cutting a middle section 28 having larger holes and then the securing portions, which have smaller holes to either side thereof.

Figure 8:
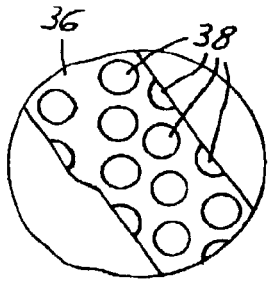
FIG. 8 is an illustration of a synthetic pocket having an exemplary no-slip surface according to yet another alternative preferred embodiment of the present invention.

As shown in FIG. 8, the netting portion 20 may have a no-slip surface 36 for providing grip between the lacrosse ball 24 and the netting portion 20. The no-slip structures can include a textured surface, such as shown in FIG. 8. Suitable textures may include semi-hemispherical protrusions 38, a hatched surface, or a variety of other surfaces as desired. Alternatively, the netting portion 20 can be formed of a no-slip material.

While particular embodiments of the present invention have been shown and described, numerous variations and alternate embodiments will occur to those skilled in the art. Accordingly, it is intended that the invention be limited only in terms of the appended claims.

What is claimed is:

1. A pocket for a lacrosse head, comprising:

an integral netting portion for attachment to the lacrosse head, said netting being relatively rigid such that it retains its shape once a pocket is formed within a portion of said integral netting portion;

said netting portion having a middle section and at least one peripheral section disposed between said middle section and a sidewall of the lacrosse head, said middle section having a first plurality of uniformly shaped holes sized for cupping a lacrosse ball within said plurality of holes and for providing friction between said lacrosse ball and said middle section of said netting portion, said at least one peripheral section having a second plurality of similary uniformly shaped holes sized smaller than each of said first plurality of holes, wherein said middle section has a coating applied thereto to impart rigidity thereto for improving throwing characteristics of the lacrosse ball.

2. The pocket of claim 1 wherein said netting portion is a multiple piece assembly characterized by said middle section and said at least one peripheral section.

3. The pocket of claim 1 wherein said netting portion includes a no-skid surface intended to grip said lacrosse ball, provide improved ball control, and impart spin to said lacrosse ball.

4. The pocket of claim 1 wherein said middle section has a coating applied thereto to impart rigidity thereto for improving throwing characteristics of the lacrosse ball.

5. The pocket of claim 4 wherein said netting material is a synthetic material selected from the group consisting of nylon, polyester, and plastic.

6. The pocket of claim 1 wherein said netting material is a synthetic material selected from the group consisting of nylon, polyester, and plastic.

7. A mesh pocket for a lacrosse head comprising:

an integral one-piece netting portion for attachment to the lacrosse head at a plurality of net attachment structures on the lacrosse head, said integral netting portion being formed of a woven material and, including:

a middle portion extending generally from a base of the lacrosse head to the scoop;

a first side portion including a plurality of generally diamond shaped openings formed therein;

an opposing second side portion; and a plurality of generally diamond shaped openings located in at least said middle portion that are sized large enough to cup a lacrosse ball to provide increased ball retention capabilities and wherein said plurality of openings substantially throughout said middle portion are sized larger than said plurality of generally diamond shaped openings in said first side portion.

8. The pocket of claim 7 wherein said second side portion includes a plurality of openings formed therein and wherein said plurality of openings in said middle portion are sized larger than said plurality of openings in said second side portion.

9. The pocket of claim 7 wherein said integral netting portion has a coating applied thereto to impart rigidity to said netting portion.

10. A pocket for attachment to a lacrosse head at a plurality of attachment locations, comprising:

an integral mesh netting being formed of a woven material and, including a middle pocket portion, a first side portion located on one side of said middle pocket portion and a second side portion located on the other side of said middle pocket portion;

a first set of generally diamond shaped openings formed in said middle portion;

a second set of generally diamond shaped openings formed in said first side portion; and a third set of generally diamond shaped openings formed in said second side portion;

wherein each of said openings in said first set of openings is larger than each of said openings in said second and said third set of openings; and wherein said integral mesh netting includes a coating applied thereto to impart rigidity to said integral mesh netting.

11. The pocket of claim 10 wherein each of said openings in said second set of openings and said third set of openings are substantially the same size.

12. The pocket of claim 10 wherein each of said openings in said first set of openings is sized large enough to cup a lacrosse ball in order to provide increase ball control.

* * * * *